United States Patent [19]

Inoue et al.

[11] Patent Number: 4,706,230

[45] Date of Patent: Nov. 10, 1987

[54] UNDERWATER LOW-FREQUENCY ULTRASONIC WAVE TRANSMITTER

[75] Inventors: Takeshi Inoue; Takatoshi Nada, both of Tokyo, Japan

[73] Assignee: NEC Corporation, Tokyo, Japan

[21] Appl. No.: 901,693

[22] Filed: Aug. 29, 1986

[51] Int. Cl.[4] ..... H01V 7/00

[52] U.S. Cl. ..... 367/174; 367/159; 367/163; 367/168; 310/337

[58] Field of Search ..... 367/157, 159, 163, 165, 367/168, 174, 173; 181/110; 310/337

[56] References Cited

U.S. PATENT DOCUMENTS

| | | | |
|---|---|---|---|
| 3,215,977 | 11/1965 | Williams et al. | 367/157 |
| 3,449,712 | 6/1969 | Angeloff | 367/157 |
| 4,384,351 | 5/1983 | Pagliarini et al. | 367/163 |
| 4,420,826 | 12/1983 | Marshall et al. | 367/159 |
| 4,432,080 | 2/1984 | Wardle | 367/166 |
| 4,435,794 | 3/1984 | Marshall et al. | 367/159 |
| 4,524,693 | 6/1985 | McMahon et al. | 367/163 |

OTHER PUBLICATIONS

Royster; "The Flextensional Concept: A New Approach to the Design of Underwater Acoustic Transducers"; *Applied Acoustics,* No. 2, 1970.

Pagliarini et al; "A Small, Wide-Band, Low-Frequency, High-Power Sound Source Utilizing the Flextensional Transducer Concept"; Conference: Oceans 78, The Ocean Challenge, Washington, D.C., 6-8 Sep. 1978.

*Primary Examiner*—Charles T. Jordan
*Assistant Examiner*—John W. Eldred
*Attorney, Agent, or Firm*—Sughrue, Mion, Zinn, Macpeak & Seas

[57] ABSTRACT

Non-active columnar members are disposed on both sides of an active columnar member consisting of a piezoelectric ceramic material or a magnetically strainable material. Levers are connected to the active and non-active columnar members via first and second hinges. Convex shells are connected to the levers via third hinges. The displacement of the active columnar member is enlarged via the lever action, thereby enabling a miniaturized ultrasonic wave transmitter having high power capability.

15 Claims, 8 Drawing Figures

FIG. 1 PRIOR ART
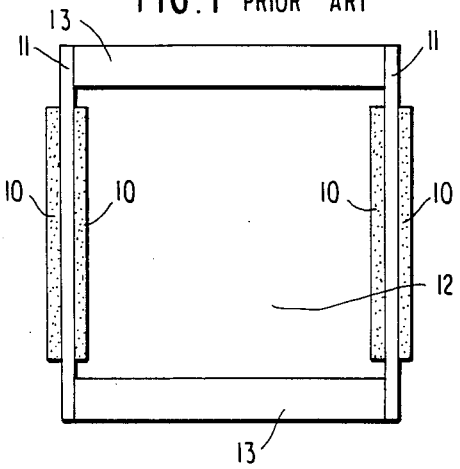
FIG. 3 PRIOR ART
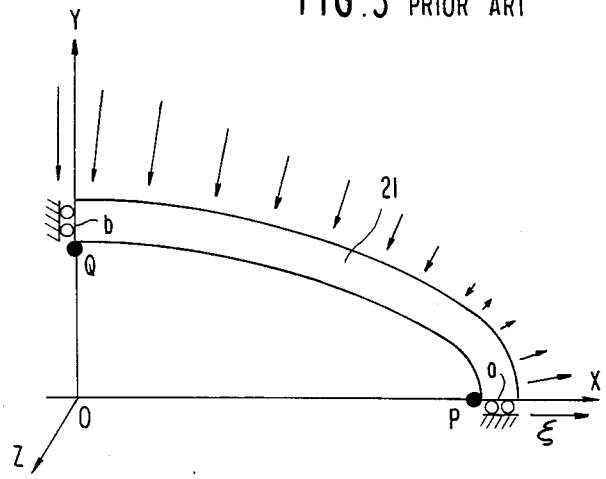
FIG. 2 PRIOR ART
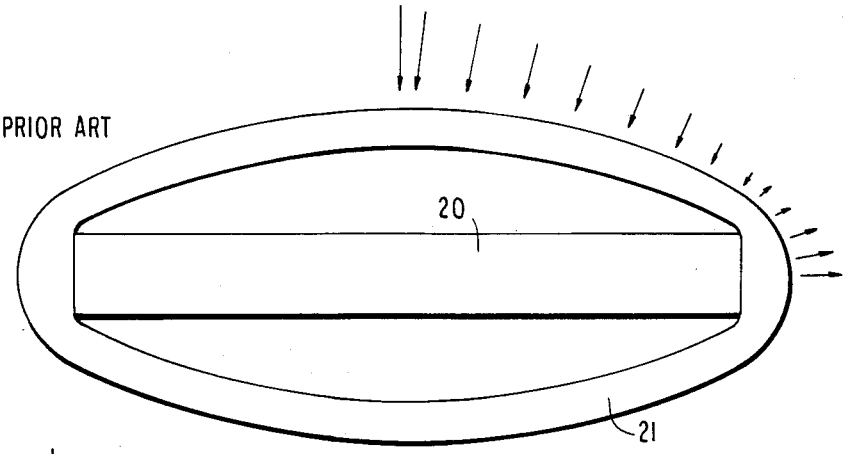
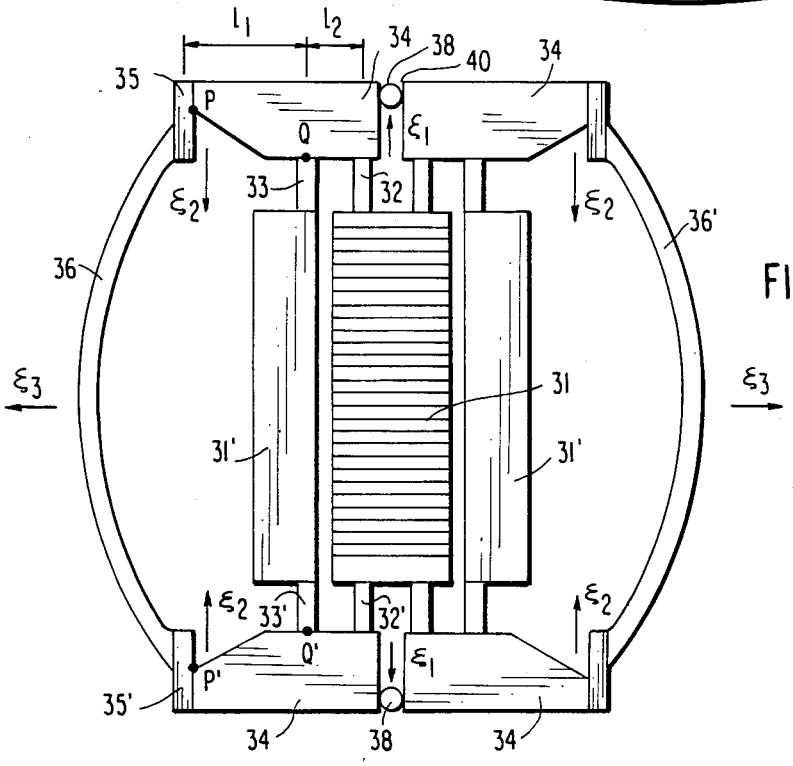
FIG. 4

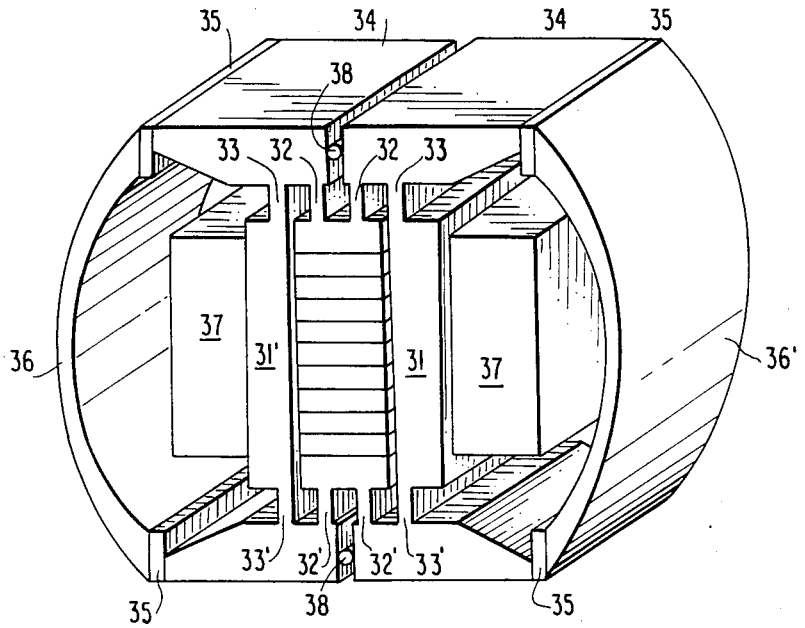
FIG.5
FIG.6B
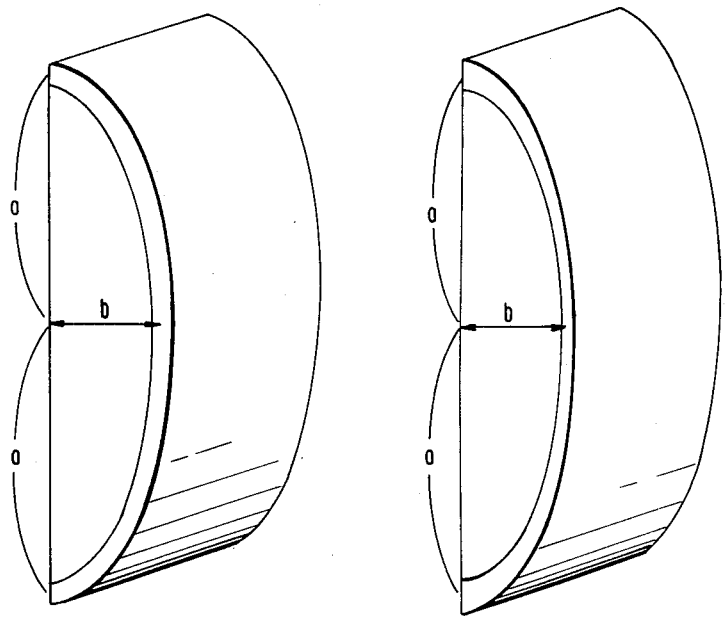
FIG.6A
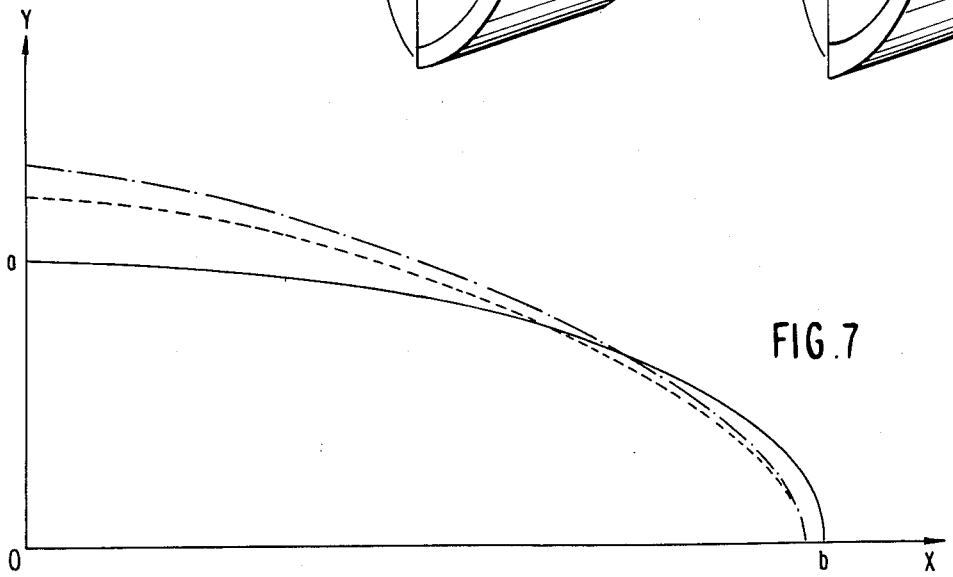
FIG.7

UNDERWATER LOW-FREQUENCY ULTRASONIC WAVE TRANSMITTER

BACKGROUND OF THE INVENTION

This invention relates to an underwater ultrasonic wave transmitter usable for long-distance sonars and in the investigation of oceanic resources, which operates at high-power at low-frequencies. The use of low-frequency ultrasonic waves for sonars and the like is advantageous because of the small propagation loss as compared with high-frequency ultrasonic waves. Conventional transmitters adapted to radiate high-power ultrasonic waves in water include the electrodynamic transmitter and the piezoelectric transmitter, which are widely known. The electrodynamic transmitter is capable of great displacement but it has small generating power. Therefore, it is very difficult to obtain a miniaturized transducer for low-frequency ultrasonic waves. The piezoelectric transmitter uses a piezoelectric ceramic material of zircon-lead titanate as an electromechanical energy-converting material. Since the acoustic impedance of the piezoelectric ceramic material is about 20 times as high as that of water, or more, the generating power of this material is very high, but this material is incapable of being displaced so as to meet the requirements of media displacement during the acoustic radiation of the transmitter. The acoustic radiation impedance per unit radiation area of the piezoelectric ceramic material decreases at a high rate as the frequency of the ultrasonic waves to be transmitted decreases. Thus, it is necessary that low-frequency acoustic radiation be carried out with the displacement of the piezoelectric ceramic material further enlarged, so as to improve the efficiency of the acoustic radiation.

The known high-power transmitters for the low-frequency band (not more than 3 KHz) include the bendable transmitter utilizing piezoelectric discs, as shown in FIG. 1, which transmitter is disclosed in, for example, R. S. Woolette, "Trends and Problems in Sonar Transducer Design", IEEE Trans. on Ultrasonics Engineering, pp 116–124 (1963), and the flextensional transmitter which uses an elliptical shell, as shown in FIG. 2, which transmitter is disclosed in, for example, G. Brigham and B. Grass, "Present Status in Flextensional Transducer Technology", J. Acoust. Soc. Am., vol. 68, No. 4, pp 1046–1052 (1980).

The bendable transmitter shown in FIG. 1 generally uses circular bimorphous oscillators. Referring to FIG. 1, reference numeral 10 denotes plates of a piezoelectric ceramic material (zircon lead titanate), and 11 indicates metal plates of nickel or stainless steel. The plates 10, 11 form bimorphous oscillators, which are used as acoustic radiators. Reference numeral 12 denotes a cavity, and 13, a housing. However, in the transmitter shown in FIG. 1, each of the bimorphous oscillators is actually obtained by bonding a plurality of ceramic segment plates in a mosaic pattern to the metal plate 11, since a one-piece piezoelectric ceramic plate 10 of the large surface area required cannot be obtained. Namely, since one-piece ceramic plates of large area are not available, thus medium-displacement capability of this transmitter is not sufficiently high, so that this transmitter is not suitable for the case where a high-power transmitter is required. Even if one-piece piezoelectric ceramic plates of a large area could be obtained, the flexure compliance of the bimorphous oscillator becomes considerably large due to the construction thereof, and a great increase in the medium-displacement capability of the transmitter cannot be expected.

The flextensional transmitter shown in FIG. 2 uses a kind of displacement-enlarging mechanism, by which, when an active columnar member 20 consisting of a piezoelectric ceramic material is expanded in the direction of the longer axis thereof, an elliptical shell 21 contracts as shown by the arrows in the drawing. The degree of displacement is several times higher than that of the displacement of the columnar member 20. (The illustrative arrows are drawn around only $\frac{1}{4}$ of the circumferential portion of the elliptical shell.) Since this transmitter uses an elliptical shell as an acoustic radiator, a structure which is far more rigid than that using bimorphous discs can be obtained. Therefore, it is said that the transmitter of FIG. 2 is better suited for the high-power transmission of ultrasonic waves than the transmitter of FIG. 1 which uses bimorphous discs.

The resonant frequency of the flextensional transmitter shown in FIG. 2 is two or more times higher than that of the elliptical shell 21 since the stiffness of the active columnar member 20 is considerably high as compared with that of the shell 21. Namely, unless the resonant frequency relative to the flextensional mode of the elliptic shell 21, which has predetermined dimensions, is reduced considerably, a reduction in the frequency and dimensions of the flextensional transmitter cannot be achieved. It has been required that the resonant frequency of the shell in the flextensional transmitter be further reduced. However, for the following reasons it has not been possible to reduce the frequency and dimensions of the elliptical shell.

In order to describe the operation of the device, a quadrant thereof is shown in FIG. 3, in which the longer axis, shorter axis and thickness of the shell are taken in the x-axis, y-axis and z-axis directions, respectively. Let (a, O) be the point at which the center of the thickness of the elliptical shell crosses the x-axis, and let (O, b) be the point at which the y-axis crosses the same center. Namely, let a and b equal the longer diameter and shorter diameter, respectively, of the elliptical shell. If the active columnar member 20 is expanded beyond point P in the positive x-direction by $\epsilon$, the shell is displaced beyond point Q in the negative y-direction by a distance several times greater than $\epsilon$, due to the displacement-enlarging mechanism of the elliptical shell, so that the shell as a whole draws the medium in. On the other hand, when the active columnar member contracts, the shell as a whole works in the medium-displacement direction. In this transmitter, a cross section of the elliptical shell, which is obtained by cutting the shell with a plane including the x-axis, is displaced in parallel with the x-axis, and the quantity of rotary displacement thereof around the z-axis is zero. Therefore, the movement of the shell is restricted to the extent corresponding to the quantity of prohibited rotary movement thereof around the z-axis, and the resonant frequency of the shell increases. In the flextensional transmitter, it is hard to reduce the resonant frequency of the shell for these reasons, and, hence, it is very difficult to reduce the frequency and dimensions of the transmitter.

It is, of course, possible to attempt changing the shape and thickness of the elliptic shell so as to reduce the frequency and dimensions of the transmitter.

When the shape of the elliptic shell is varied, the resonant frequency of the shell certainly decreases in inverse proportion to b/a, i.e., as the shape of the shell is set more similar to a circle. However, in this case, as b/a is increased, the displacement-enlargment rate decreases greatly in comparison with the frequency. Therefore, the merits of changing the shape of the shell to miniaturize the shell are lost. It has also been ascertained that, when the thickness of the shell is reduced, the resonant frequency of the transmitter decreases. However, in this case, the medium-displacement capacity and the water pressure-resisting characteristics of the shell are greatly deteriorated.

SUMMARY OF THE INVENTION

Therefore, an object of the present invention is to provide a miniaturized ultrasonic wave transmitter.

Another object of the invention is to provide a ultrasonic wave transmitter having excellent high-power characteristics in the low-frequency band.

Still another object of the invention is to provide an ultrasonic wave transmitter exhibiting bidirectivity or no directivity.

Another object of the invention is to provide an ultrasonic wave transmitter having high pressure-resistance.

According to the invention there is provided an ultrasonic wave transmitter comprising, an active columnar member consisting of a piezoelectric ceramic material or a magnetically strainable material, non-active columnar members disposed on both sides of the active columnar member, levers connected to the active and non-active columnar members via first and second hinges, and convex shells connected to each the levers via third hinges.

Other objects and features will be clarified from the following explanation, with reference to the drawings.

BRIEF DESCRIPTION OF THE DRAWINGS

FIG. 1 shows a conventional bendable transmitter;

FIG. 2 shows a conventional flextensional transmitter;

FIG. 3 shows an elliptical shell used in the conventional flextensional transmitter;

FIG. 4 illustrates the principle of the operation of the transmitter according to the present invention;

FIG. 5 is a perspective view of the transmitter according to the present invention;

FIG. 6 is a perspective view of the convex shells applied to the transmitter according to the present invention, wherein FIG. 6A shows a conventional uniform shell, and;

FIG. 6B shows a non-uniform shell used in the transmitter according to the present invention; and FIG. 7 is a diagram showing the displacement distribution of the convex shells;

DETAILED DESCRIPTION OF THE PREFERRED EMBODIMENTS

The transmitter according to the present invention will now be described with reference to the accompanying drawings.

FIG. 4 shows an example of the transmitter according to the present invention. The principle of operation of the transmitter of FIG. 4 will be described in detail. Referring to FIG. 4, reference numeral 31 denotes an active columnar member consisting of a piezoelectric ceramic material or a magnetically strainable material, which is adapted to be excited longitudinally when a voltage or an electric current is applied thereto. The active columnar member 31 is joined to levers 34 via hinges 32, 32'. The non-active columnar members 31' are connected to the levers 34 via hinges 33, 33'. The system consisting of the hinges and non-active columnar members is formed of a material having a high mechanical strength, such as high-tension steel, and has considerably high rigidity with respect to the longitudinal displacement thereof. This system is designed so that it works flexibly with respect to a bending force.

When the active columnar member is displaced by $\epsilon_1$ as shown by arrows in FIG. 4, the levers 34 turn inward at an angle $\theta$, and enlarged displacement $\epsilon_2$ occurs at the ends P, P' of the levers. Since the levers consist of a material having a sufficiently high rigidity (for example, high-tension stainless steel), they turn substantially like rigid bodies. Let $l_1$ equal the distance between the hinges 32, 33 (or 32', 33') and $l_2$ equal the distance between the hinge 33 and P (or 33' and P'). The geometrically enlarged displacement $\epsilon_2$ is:

$$|\epsilon_2| = (l_2/l_1)\ |\epsilon_1| \qquad (1)$$

If, for example, $l_2 = 3l_1$, the displacement $\epsilon_1$ of the active columnar member is multiplied by a factor of 3 at the points P, P'. During this time, the non-active columnar members, which work as fulcrums, efficiently transmit the longitudinal oscillations generated in the active columnar member 31 to the levers 34. Therefore, it is necessary that the rigidity of the non-active columnar member with respect to the longitudinal oscillation be set to a considerably high level as previously described. When the levers 34 are turned around the fulcrums Q, Q' at angle $\theta$, the bending displacement of angle $\theta$ also occurs in the hinges 32, 32'; 33, 33', which contact the levers, so that a bending moment occurs. This bending moment increases in inverse proportion to the bending compliance of the hinges 32, 32'; 33, 33'. Namely, the turning of the levers 34 is suppressed to an increased extent in inverse proportion to the bending compliance of the hinges 32, 32'; 33, 33'. Each of the hinges 32, 32'; 33, 33' suitably consists of a hinge (for example, a flat hinge) having small longitudinal compliance and large bending compliance. Namely, even when the levers 34 are turned at an angle $\theta$ with respect to the first-step displacement-enlarging mechanism, the bending moment is offset due to the construction thereof, and the level of the bending moment occurring in the active columnar member 31 becomes substantially zero. In other words, substantially no bending displacement occurs in the active columnar member, and this enables a rigid first-step displacement-enlarging mechanism to be obtained.

Concerning the two-step displacement-enlarging mechanism, when the levers 34 are displaced longitudinally from the points P, P' by $\epsilon_2$, the convex shells are displaced via the hinges 35, 35', owing to the effect of the shape thereof, in the direction of the arrows by an amount $\epsilon_3$, the quantity of which is larger than $\epsilon_2$. During this time, the hinges 35, 35' transmit the longitudinal displacement from the levers 34 to the shells. Accordingly, it is necessary that the hinges 35, 35' be designed so as to have a high rigidity with respect to longitudinal force. In order to reduce the frequency and dimensions of the transmitter, it is necessary that the resonant frequency of the system, which consists of the shells 36, 36' and hinges 35, 35', be reduced. It is effective to design the hinges 35, 35' so that they can work flexibly with respect to a bending displacement. It has been ascertained by experiment that, when the bending compliance of the hinges is set high to enable the hinges to be moved flexibly with respect to a turning force, as in the present invention, the resonant frequency of the system, which consists of the shells and hinges, decreases to as low as about $\frac{1}{2}$ that of a system of shells 36, 36' and hinges 35, 35' which are supported on rolls so as to prevent the shells from being turned at the joint portions of the shells and hinges. Hence, the frequency and dimensions of the transmitter according to the present invention can be further reduced as compared with a transmitter in which the convex shells 36, 36' are bonded directly to the legvers 34 without the hinges 35, 35'. Since the transmitter according to the present invention has a two-step displacement-enlarging mechanism, the acoustic radiation surfaces (outer surfaces of the shells) are greatly displaced, and even a miniaturized transmitter displays excellent acoustic radiation capability.

Another advantageous feature of the underwater low-frequency ultrasonic wave transmitter according to the present invention resides in that the displacement at the acoustic radiators can be enlarged n times ($n>>1$) that of the active columnar member. Therefore, the mass of the acoustic radiators becomes $n^2$ times as large as that of the active columnar member, so that a lightened and miniaturized low-frequency can be obtained.

The above is a description of the principle of the operation of the low-frequency ultrasonic wave transmitter according to the present invention. The load of the acoustic radiation in water, i.e., the intrinsic acoustic impedance (defined by the product of density and sonic speed) is $1.5\times10^6$ MKS rayls. Accordingly, there are various restrictions on carrying out efficient acoustic radiation using this transducer.

In order to make the three-dimensional shape of this transducer understood clearly, a perspective view is given in FIG. 5.

The displacement caused by the active columnar member is transmitted to the levers 34 via the hinges 32, 33 (32', 33'). In order to efficiently convert the longitudinally acting energy of the active columnar member into the rotary energy of the levers 34, it is very important to suitably select the sizes and shapes of the hinges 32, 33 (32', 33'). The hinges 32, 33 (32', 33') have to efficiently transmit the power output from the active columnar member 31 to the levers longitudinally. The power transmitting capability of the hinges is thus improved in proportion to the longitudinal stiffness thereof.

When the levers 34 are turned, the hinges are bent in accordance with the turning movement thereof. During this time, the ease of bending the levers is in inverse proportion to the bending stiffness of the hinges. It can thus be said that hinges of higher longitudinal stiffness and lower bending stiffness exhibit better performance. Hinges having a longitudinal stiffness of $\infty$ and a bending stiffness of zero are ideal hinges.

Let w and h equal the width and height of the hinges. As the width w is increased, the bending stiffness of the hinges and the longitudinal stiffness thereof become higher. As the height h is increased, both the bending stiffness and longitudinal stiffness of the hinges become lower.

The energy transmitting efficiency of the transmitter of FIG. 4 was investigated in detail. As a result, it was discovered that the sizes w and h have optimum relative values, and that, when the size ratio h/w was in the range of 1.5–4.2, energy was transmitted from the active columnar member 32 to the levers 34 without a great decrease in energy transmitting efficiency.

The hinges 35 are adapted to transmit the pivotal displacement of the levers 34 to the shells 36. When the transmitter as a whole is immersed in water, the hinges 35 receive the force of bending displacement via the shells 36. If the strength of the hinges is insufficient, the water pressure-resisting characteristics of the transmitter are deteriorated. As previously mentioned, in a transmitter of rigid construction in which the turning of the levers is impossible, it is difficult to reduce the frequency and dimensions of the transmitter.

This inconvenience can be eliminated very effectively by tapering the levers 34 as shown in FIG. 5, and joining the levers 34 and shells 36, 36' to each other via hinges 35 so that the surfaces of the end portions of the levers 34 and the bottom surfaces of the shells 36, 36' are superposed on each other, either partially or wholly. This enables the improvement of the water pressure-resisting characteristics of the transmitter and permits the reduction of the frequency and dimensions thereof.

The levers 34, hinges 35, 35' and shells 36, 36' may, of course, be integrally formed.

The construction of a convex shell used in a regular flextensional transmitter is shown in FIG. 6A. The thickness of this shell is constant at every part thereof. This shall be designated the "uniform shell" design. The value b/a, which is obtained by dividing the shorter diameter b of the shell by the longer diameter a, constitutes an important factor in the determination of the shape of the shell.

It is known that, when b/a is large, the displacement $\epsilon_3$ of the central portion of the shell does not become large with respect to the output displacement $\epsilon_2$ of the levers 34. In order to increase $\epsilon_3/\epsilon_2$, it is necessary that the value of b/a be not more than 0.5.

When b/a is set to a low level to form flattened shells, it is possible to increase $\epsilon_3/\epsilon_2$. However, when b/a is not more than 0.2, the water pressure-resisting characteristics of the transmitter rapidly deteriorate. Moreover, oscillatory stress occurs in a concentrated manner in the root portions of the shells during a high-power ultrasonic wave transmitting operation.

Namely, in a uniform shell, $\epsilon_3/\epsilon_2$ cannot be set at a high level, and oscillatory stress occurs in a concentrated manner in the root portions of the shells.

Therefore, in the transmitter according to the present invention, the portions of the shell which are joined to the hinges 35, 35' are made thicker, and the intermediate portion thereof thinnest, as shown in FIG. 6B; i.e., non-uniform shells are used to solve these problems.

FIG. 7 comparatively shows the oscillatory displacement distribution of a uniform shell and a non-uniform shell, in both of which b/a is 0.35 by way of example. In FIG. 7, the center, longer axes and shorter axes of the shells are respectively plotted on the origin, X-axis and Y-axis of the graph, and the oscillatory displacement distribution of the shells, which is determined when the shells are compressed by the displacement $\epsilon_2$ outputted from the levers 34, is shown in partial lines. In the determination of the oscillatory displacement distribution, the values at the centers of the thicknesses of these shells are selected as the representative values. The shells consist of a steel alloy. Referring to FIG. 7, the solid line shows the shells before displacement, the one-dot chain line outlines the oscillatory displacement distribution of the non-uniform shell, and the broken line indicates the oscillatory displacement distribution of the conventional uniform shell. This displacement distribution diagram is obtained by plotting the coordinates with the displacement $\epsilon_2$ assumed to be constant, with the actual quantities of displacement enlarged 500 times. The displacement enlargement rate $\epsilon_3/\epsilon_2$ of the non-uniform shell is 4.67, and that of the uniform shell is 3.46. This indicates that using non-uniform shells certainly enables acoustic radiation to be carried out more advantageously. It has been ascertained on the basis of experimental results and by the calculation of numerical values by a finite element method (FEM) that such displacement distribution does not substantially depend upon the material in use, which may include iron, aluminum alloy, glass fiber-reinforced plastics and carbon fiber-reinforced plastics. Among the non-uniform shells, a non-uniform shell having a maximum thickness/minimum thickness ratio of 1.4–5.2 enables the acoustic radiation to be carried out with especially good effect.

In the manufacture of the transmitter according to the present invention, it is very important to consider how to efficiently convert into acoustical radiation, the oscillatory energy of the active columnar member, which consists of a piezoelectric ceramic material or a rare earth magnetically-strainable material, and which has an intrinsic acoustic impedance far higher than that of water. The attainment of a transmitter having small dimensions and excellent performance depends upon the results of this consideration.

The conventional flextensional transmitter shown in FIG. 6 has a displacement-enlarging mechanism consisting of the shells alone, so that the displacement-enlarging rate thereof is seven times (7×) at the highest. In order to carry out efficient acoustic radiation in water, in practice, such a low displacement rate is insufficient.

As previously mentioned, the transmitter according to the present invention has a displacement-enlarging rate $\epsilon_3/\epsilon_1$ far higher than that of the conventional flextensional transmitter. When an acoustic radiation operation is carried out in water, the acoustic radiation surface receives a considerably high pressure from the water, a load medium. This pressure is based on the so-called acoustic radiation impedance. If the transmitter is designed so as to have an extremely high displacement-enlarging rate $\epsilon_3/\epsilon_1$, the medium-displacement power becomes short, and it becomes difficult to carry out the high-power transmission of ultrasonic waves. An analysis of the inventive transmitter by the finite element method (FEM) and several experiments on the same transmitter were made. The results show that the overall displacement-enlarging rate $\epsilon_3/\epsilon_1$ has an optimum value, and that, when $10 \leqq \epsilon_3/\epsilon_1 \leqq 25$, the acoustic impedance matching with respect to water is sufficient to enable the broad-band transmission of ultrasonic waves to be carried out with high efficiency. When $\epsilon_3/\epsilon_1$ is less than 10, the performance of this transmitter becomes not largely different from that of the conventional device.

The transmitter according to the present invention has a symmetric construction, so that acoustic radiation can be conducted evenly in the left and right portions thereof. When this transmitter is immersed in water, it receives static water pressure which tends to flatten the shells, and the levers 34 are thus displaced so that they rotate such that the distance between points P, P' increases. This can cause the levers to abut one another at locations 40. However, if FRP (Fiber Reinforced Plastics) rods or acoustic decoupling material, for example, onion skin paper 38 is inserted between the left and right levers in this area, the water pressure-resistance thereof can be easily improved. In this transmitter, the active columnar member 31, which consists of a piezoelectric ceramic material or a magnetically strainable material, ultimately receives the water pressure via hinges 32, so that a compressive force is applied thereto. Since the material mentioned above and constituting the active columnar member 31 has a compressive force-resisting strength which is several times as high as the tension-resisting strength thereof, the transmitter has superior water pressure resistance owing to its substantial construction. This transmitter is also advantageous in that water pressure is not applied directly to the active columnar member for the following reasons. The water pressure applied from the levers 33, 33' to the hinges 35, 35' causes a tensile force to occur in the active columnar member 31, and the water pressure applied to the shells 36, 36' causes a compressive force to occur therein, the tensile force and compressive force offsetting each other.

One of the other merits of this transmitter resides in that a transformer-containing transmitter can be obtained by attaching transformers to the non-active columnar members 31, 31' by regular means, such as bolts, as shown in FIG. 5. When transformers are installed in the transmitter, the electric power can be supplied at a low voltage from the power source to the transmitter through cables. Therefore, a transformer-containing transmitter has considerable advantages. In view of the construction of the flextensional transmitter shown in FIG. 2, it is impossible to install transformers therein.

An underwater ultrasonic wave transmitter using convex shells will now be described as an embodiment of the present invention with reference to FIG. 4. The transmitter using convex shells shown in FIG. 4 was housed in a housing of FRP having a wall thickness of 10 cm. During this time, an acoustic decoupling member, which contains cork and synthetic rubber as main components, is inserted between the levers 34 and the housing case so as to prevent the transmitter and housing case from being acoustically connected, and so as not to prevent the pivotal movement of the levers 34. Each of the convex shells consists of half of an elliptic body in which the ratio of the length of the shorter axis thereof to that of the longer axis is 0.4. The length $2a$ of the longer axis of the shell was set to 50 cm, the depth thereof to 40 cm and the thickness thereof to 1.0–2.0 cm. The levers, hinges and convex shells are all formed of high-tension steel. The resonant frequency in air of the transmitter made for trial was 470 Hz. The displacement of the central portion of the convex shell was about 12 times as large as that of the active columnar member. The active columnar member used was obtained by laminating piezoelectric ceramic rings which were polarized in the direction of the thickness thereof, and tightening the lamination with bolts.

This transmitter was then placed in water and driven at high power to measure the sound pressure at a position 1 m away from the acoustic radiation surfaces. A sound pressure of 190 dB per $\mu$Pa was easily obtained at 400 Hz. The 6 dB comparative band width at the transmission voltage was 32%. The ultrasonic waves displayed substantially no directivity at low frequency, and a directivity similar to bidirectivity as the frequency increased. It was ascertained that this transmitter operated normally at a depth of 200 m.

We claim:

1. An underwater low-frequency ultrasonic wave transmitter, comprising; an active columnar member comprising a piezoelectric ceramic material, a non-active columnar member disposed on either side of said active columnar member, convex shells acting as acoustic radiation surfaces arranged outwardly of said non-active columnar members, and displacement enlarging means for coupling said non-active and active columnar members to said convex shells.

2. An underwater low-frequency ultrasonic wave transmitter as claimed in claim 1 wherein said coupling means comprises lever means coupled to said active columnar member via first hinge means, coupled to said non-active columnar member via second hinge means, and coupled to an end of said convex shell via third hinge means.

3. An underwater low-frequency ultrasonic wave transmitter as claimed in claim 2, wherein said first and second hinges have a height-to-width ratio of 1.5–4.2.

4. An underwater low-frequency ultrasonic wave transmitter according to claim 2, wherein said levers are tapered toward ends thereof coupled to said convex shells.

5. An underwater low-frequency ultrasonic wave transmitter according to claim 4, wherein said levers and said convex shells are connected to each other through said third hinges such that ends of said levers and ends of said shells are partially superposed.

6. An underwater low-frequency ultrasonic wave transmitter according to claim 1, wherein each of said convex shells is formed so that the thickness thereof decreases gradually from ends thereof to an intermediate portion thereof.

7. An underwater low-frequency ultrasonic wave transmitter according to claim 6, wherein the ratio of maximum thickness/minimum thickness of said convex shell ranges from 1.4 to 5.2.

8. An underwater low-frequency ultrasonic wave transmitter according to claim 2, wherein FRP rods are inserted between adjacent levers.

9. An underwater low-frequency ultrasonic wave transmitter according to claim 1, wherein voltage or current transformers are provided between said non-active columnar members and said convex shells.

10. An underwater low-frequency ultrasonic wave transmitter according to claim 9, wherein said transformers are fixed to said non-active columnar members.

11. An underwater low-frequency ultrasonic wave transmitter according to claim 1, wherein the ratio of the displacement of said active columnar member to that of said convex shell ranges from 10 to 25.

12. An underwater low-frequency ultrasonic wave transmitter comprising; an expansible active columnar member for generating a first displacement, first means for magnifying said first displacement of said columnar member, and second means coupled to said first means for receiving said magnified first displacement and for generating a second displacement in a direction perpendicular to said first displacement, said second means comprising an acoustic radiator, said second displacement being larger than said magnified first displacement due to further displacement magnification performed by said second means.

13. An underwater low-frequency ultrasonic wave transmitter, comprising: an active columnar member comprising a magnetically strainable material, a non-active columnar member disposed on either side of said active columnar member, convex shells acting as acoustic radiation surfaces arranged outwardly of said non-active columnar members, and displacement enlarging means for coupling said non-active and active columnar members to said convex shells.

14. An underwater low-frequency ultrasonic wave transmitter according to claim 4, wherein said levers and said convex shells are connected to each other through said third hinges such that ends of said levers and ends of said shells are wholly superposed.

15. An underwater low-frequency ultrasonic wave transmitter according to claim 2, wherein acoustic decoupling members are inserted between adjacent levers.

* * * * *

UNITED STATES PATENT AND TRADEMARK OFFICE

CERTIFICATE OF CORRECTION

PATENT NO. : 4,706,230

DATED : November 10, 1987

INVENTOR(S) : Takeshi Inoue et al

It is certified that error appears in the above-identified patent and that said Letters Patent is hereby corrected as shown below:

Column 5, line 12, delete "legvers" and insert --levers--.

Column 9, line 12, after "claim 1" insert --, or 13,--;

line 31, after "claim 1," insert --or 13,--.

Column 10, line 2, after "claim 1," insert --or 13,--;

line 9, after "claim 1," insert --or 13,--.

Signed and Sealed this

Ninth Day of August, 1988

*Attest:*

*Attesting Officer*

DONALD J. QUIGG

*Commissioner of Patents and Trademarks*